United States Patent [19]

Cleveland

[11] Patent Number: 4,531,635

[45] Date of Patent: Jul. 30, 1985

[54] HIDING PLACE FOR KEYS AND SIMILAR ARTICLES

[75] Inventor: George D. Cleveland, Long Lake, Minn.

[73] Assignee: Mary Ellen Enterprises Inc., St. Louis Park, Minn.

[21] Appl. No.: 595,562

[22] Filed: Mar. 30, 1984

[51] Int. Cl.[3] ..... A45C 11/32

[52] U.S. Cl. ..... 206/457; 206/37.1; 206/37.4; 428/15; 220/DIG. 13

[58] Field of Search ..... 206/0.81, 0.83, 37, 206/37.1, 38, 37.4, 457, 525; 229/17 B, 17 SC; 220/345, DIG. 13; 150/40; 70/456 R, 458; D3/61, 62, 65; D11/157; 428/15, 919

[56] References Cited

U.S. PATENT DOCUMENTS

| | | | |
|---|---|---|---|
| 2,627,743 | 2/1953 | Ribbing | D3/61 |
| 2,704,903 | 3/1955 | Laughlin | 428/919 |
| 3,127,918 | 4/1964 | McElrain | 150/40 |
| 3,406,821 | 10/1968 | Weissberg | 220/345 |
| 3,630,344 | 12/1971 | Bergh et al. | 220/345 |
| 3,684,292 | 8/1972 | Penrod et al. | 428/15 |
| 4,356,928 | 11/1972 | Stafford | 206/457 |
| 4,385,088 | 5/1983 | Baskin | 428/15 |

FOREIGN PATENT DOCUMENTS

| | | | |
|---|---|---|---|
| 1325688 | 3/1963 | France | 70/456 |
| 2248675 | 5/1975 | France | 206/45.34 |

*Primary Examiner*—George E. Lowrance
*Assistant Examiner*—Brenda J. Ehrhardt
*Attorney, Agent, or Firm*—James V. Harmon

[57] ABSTRACT

A plastic article is provided resembling a natural object such as a rock for hiding door keys and similar articles. It is composed of a rigid body of resin such as a water extended polyester resin having a multiply-contoured, irregular upper surface and a flat lower surface. Inside is a key holding pocket that communicates with the lower surface through an opening having slots along each side to support a sliding door formed from sheet material.

6 Claims, 9 Drawing Figures

HIDING PLACE FOR KEYS AND SIMILAR ARTICLES

FIELD OF THE INVENTION

The invention relates to articles for hiding things such as keys and more particularly to an article for hiding keys and the like which resembles a common natural object such as a stone or a rock.

BACKGROUND OF THE INVENTION

It is often desirable to have a key hidden in case the key that is usually used is lost. For many years there has been a need for an effective and secure hiding place for door keys and similar articles. However, in recent years with the tremendous increase in the number of children who must unlock the door to their home after returning from school to let themselves in, there is an even greater demand for an effective and secure hiding place for door keys. It is undesirable to hide keys in well-known places such as under a door mat, in the mailbox or over the door. The present invention provides a highly secret and secure location to hide spare keys. It is ideal for children who must open the door to their home by unlocking it with their own key. To be completely effective, the article must keep the key relatively dry under most conditions and should not let insects and the like enter the pocket where the key is stored. It should also be inexpensive, safe, able to withstand all weather conditions. Moreover, the door should not show and the entire article should be virtually unbreakable.

In the accomplishment of the foregoing and related advantages and objectives, the present invention comprises the features hereinafter fully described and particularly pointed out in the claims, the following description setting forth in detail certain illustrative embodiments of the invention by way of example, these being indicative, however, of but a few of the various ways in which the principles of the invention may be employed.

SUMMARY OF THE INVENTION

Briefly, the present invention provides a hiding place for keys and possibly other items as desired which comprises a solid body of plastic resin having a contoured upper surface and a lower support surface that is relatively flat in most instances. The upper surface has an irregular shape composed preferably of multiple connected surfaces of different contours with irregularities therein resembling a common rock or stone. The lower support surface is the bottom of the article and defines a reference plane for a sliding door which is used to cover a key-holding pocket that communicates only with the flat support surface. The pocket has a door positioned between itself and the support surface. The article includes a pair of horizontally disposed door retaining slots which are positioned in parallel relationship. The slots open toward one another and run along the sides of an opening at the bottom end of the pocket where the pocket joins the flat support surface. The door which is preferably a flat sheet has a pair of parallel side edges adapted to fit slidably within the slots and to slide in or out to either expose items held in the pocket or to cover them for storage. The article can be composed of a variety of plastic resins but is preferably formed from a thermosetting resin such as a water extended polyester resin.

THE FIGURES

DETAILED DESCRIPTION OF THE PREFERRED EMBODIMENTS

Figure 1:
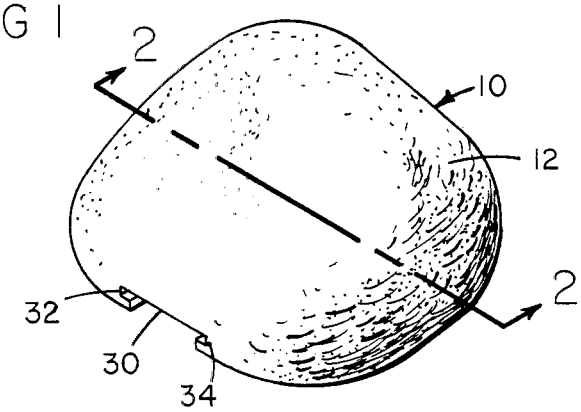
FIG. 1 is a perspective view of an article embodying the invention.
Figure 2:
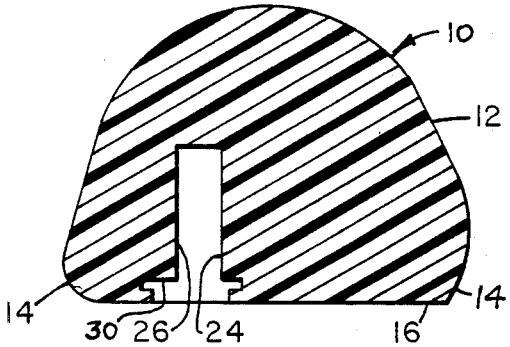
FIG. 2 is a transverse sectional view taken on line 2—2 of FIG. 1.

Refer now to the figures, and particularly to FIGS. 1–4 which illustrate one preferred embodiment of the invention. Shown in the figures is an article container 10 that serves as a hiding place for keys and similar items. It comprises a solid rigid body of plastic resin having a contoured upper surface 12. The contoured upper surface 12 preferably has an irregular shape composed of multiple connected surfaces of different configurations with tiny surface irregularities therein to resemble a common rock or stone. The multiple connected surfaces of different configurations can be easily seen by comparing FIGS. 1, 2 and 4. Minor surface irregularities are used to provide the surface texture desired to resemble a stone or other natural object. This is illustrated particularly at the right side of FIG. 1. The article also includes a bottom surface 16 which is usually flat and serves as a support. Adjacent the bottom surface, the upper surface 12 is rounded with radii as shown at 14 curved toward the bottom surface 16 so that the article, when placed on the ground, will more accurately resemble a natural rock. This is because the radii 14 help to keep the flat bottom surface from being seen.

Within the article is a pocket 20 for storing items such as a key 40. The pocket has parallel walls 24 and 26 that extend vertically from the flat bottom wall 36 and is of sufficient size to hold several keys. The pocket 20 also includes a recess 27 at one end that can be used to accommodate the largest part of the key 40. While the pocket of a particular shape has been shown, other shapes will be apparent. At the lower end of the pocket 20 is an opening 30 somewhat larger in size than the pocket in this case and extending transversely from one end of the pocket to the other. The opening 30 communicates between the pocket and the flat bottom support surface 16 of the article.

Figure 3:
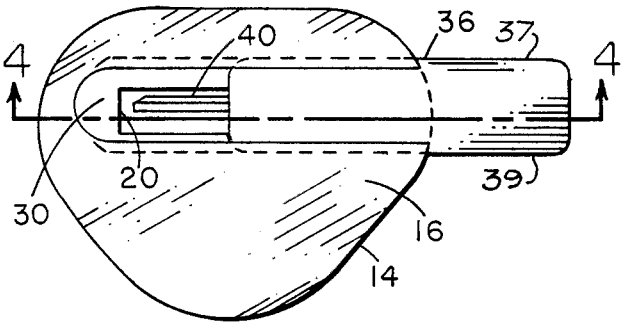
FIG. 3 is a bottom view of the invention with the door in a partially open position.
Figure 4:
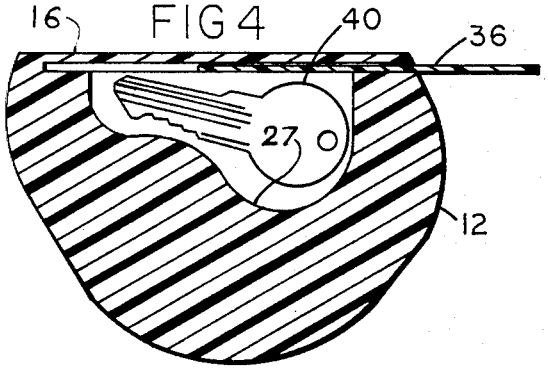
FIG. 4 is a transverse sectional view taken on line 4—4 of FIG. 3.

Extending longitudinally along the edge of the opening 30 are a pair of parallel door support slots 32 and 34. These slots 32 and 34 extend through the upper contoured surface 12 at one end as shown clearly in FIG. 1 and at the right of FIGS. 3 and 4. The slots 32, 34 open toward one another and are of just the proper size to accommodate parallel side edges 37 and 39 of a door 36 composed of sheet material which is slidably mounted within the opening 30. When the key 40 is to be covered, the door 36 is slid toward the left as seen in FIGS. 3 and 4. When the key 40 is to be removed, the door 36 is slid toward the right in the figures allowing the key to be lifted out of the pocket by removing it through the opening 30. The door 36 can be composed of any suitable material such as sheet plastic, preferably of rigid or semi-rigid construction and may include the manufacturer's name, directions for use and the like printed on one surface. As shown, the door 36 includes parallel flat upper and lower surfaces which are joined together by the parallel side edges 37 and 39.

Thus, the present invention provides an imitation rock that looks so much like the real thing that is difficult to tell the difference. The flat bottom 16 serves as a support surface and the contoured top or upper surface 12 with its irregularities, ridges, contours and irregular surface texture makes the article look identical to a real stone. While the article can be formed from a variety of resins, it is preferably formed from a water extended polyester resin that has been rigidified using any suitable catalyst normally employed with a polyester resin. To prepare the article from such a resin, water is vigorously mixed an equal amount of resin until a uniform mixture is achieved. A small amount of a suitable catalyst is then added with additional mixing to uniformly distribute the catalyst through the water and resin mixture. This mixture will typically have a pot life of about three minutes. The resin is then molded and allowed to set up during which time an exothermic reaction takes place as the resin and water mixture hardens in the mold. Suitable resins and catalysts of the kind employed are available commercially; the resin per se forms no part of the present invention. In most instances, a suitable pigment such as a gray or brown pigment is added to the resin to provide the proper color.

While preferred resins have been decribed, other resins can be employed such as phenolic resins and aminoaldehyde. Other resins will be apparent such as urethane resins or epoxy resins. Water extended polyester resins are preferred primarily for three reasons. First, the weather resistance is excellent; second, they are relatively inexpensive; and third, the dull surface texture has a natural tendency to resemble a stone or other natural object.

Figure 5:
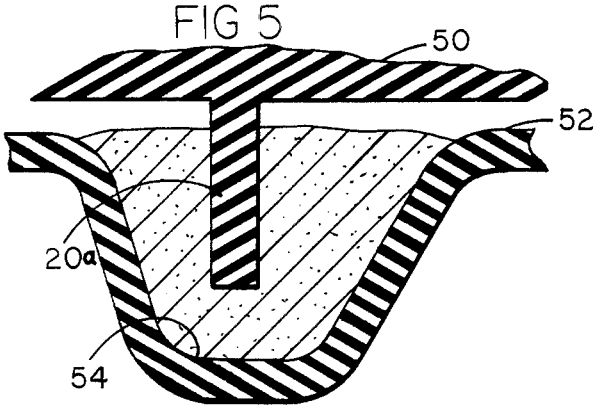
FIG. 5 is a semi-diagrammatic vertical cross sectional view illustrating a method of forming articles in accordance with the invention.
Figure 6:
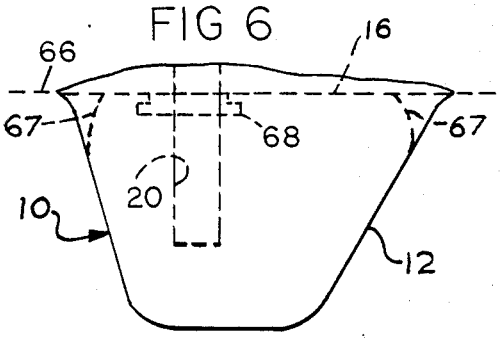
FIG. 6 is a semi-diagrammatic side view of an article formed as illustrated in FIG. 5.

Refer now to FIGS. 5 and 6 which illustrate a typical molding operation used for making articles in accordance with the present invention. As shown in FIG. 5 a rubber mold is provided including an upper part 50 and a lower part 52, the latter including a recess or mold cavity 54 resembling a rock or stone, the upper part 50 having a downwardly extending projection 20*a* that is used for forming the pocket 20. When the mold is assembled as shown in FIG. 5, the liquid resin is introduced into the pocket 54 and allowed to harden. The rubber mold elements 50 and 52 are then peeled off to expose the freshly made part shown in FIG. 6. After the part has been removed from the mold and the cavity forming projection 20*a* removed from the cavity or pocket 20, the flat bottom surface 16 is formed by grinding or planing away material along line 66 until a flat surface is formed. The flat surface 16 serves as a reference plane for the next operation, that is, the operation of forming the opening 30 and the recesses 32, 34 by routing at 68. This can be easily accomplished by inverting the article from the position shown in FIG. 6 over the upwardly extending cutting head of a suitable router (not shown) and sliding the article 10 back and forth over the routing head until the routing at 68 is accomplished.

It will be understood that, if desired, the rubber mold 52 can be provided with inwardly or centrally curved upper edges to provide centrally curved radii as shown at 67 in FIG. 6 to assist in hiding the bottom surface 16 by making it less visible. Since the mold 52 is formed from rubber, it can be easily peeled away from the radii 67 allowing the article 10 to be removed from the mold. Mold cavities can be formed from a variety of elastic materials such as silicone rubber.

Figure 7:
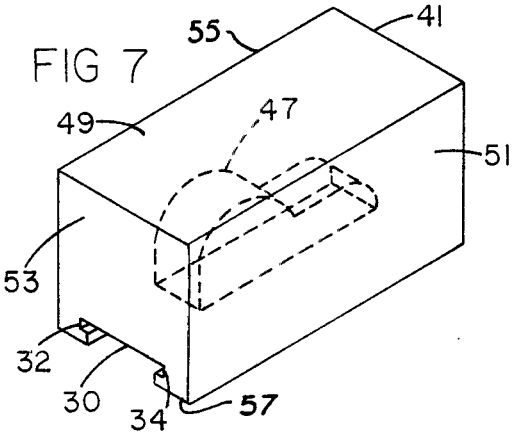
FIG. 7 is a perspective view of another embodiment of the invention.

Refer now to FIG. 7 which shows a modified form of the invention.

FIG. 7 shows a form of the invention in which the article comprises a body of plastic resin having a geometric configuration, namely that of a solid rectangle with a pair of flat end walls 41 and 53 at opposite ends, flat top wall 49 and flat side walls 51 and 55. The article also includes a flat bottom wall 57 and a storage pocket 47 for the keys or other items that communicates through the opening 30 with the bottom wall 57. The opening 30 has slots 32, 34 for holding a cover (not shown) in a manner similar to that described above.

FIG. 7 illustrates how the invention can have a geometric shape but may resemble a common object.

Figure 8:
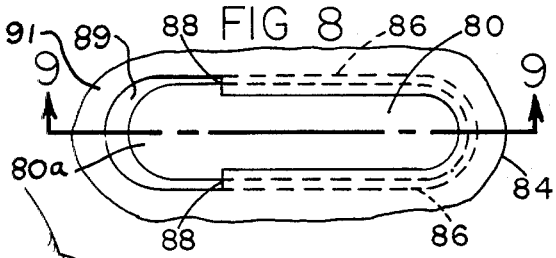
FIG. 8 is a partial bottom view of the invention showing a modified form of door opening and FIG. 9 is a partial vertical sectional view taken on line 9—9 of FIG. 8.
Figure 9:
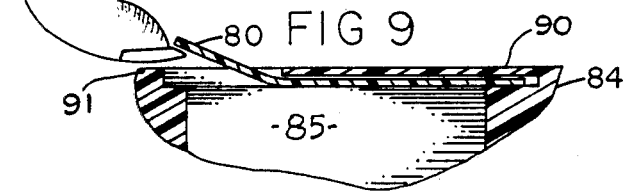

Refer now to FIGS. 8 and 9 which show a modified form of the invention. As seen in the figures, the article holder 84 is provided with a key holding pocket 85 which communicates through an opening 89 with a bottom wall 90 that is used as a support surface in a manner similar to that already described. The pocket 85 and the article 84 are, in all respects, similar to that described except as will be described below. Adjacent the opening 89 are provided parallel longitudinally extending grooves 86 similar to the grooves 32, 34 except that the grooves 86 terminate at 88 and from the point of the termination at 88, no material is present above the door 80. This enables one to place a finger beneath the exposed portion 80*a* at the left end of the door allowing it to be raised and then withdrawn by pulling it over the shoulder 91 which encloses the left end of the opening 89. The embodiment of FIGS. 8 and 9 requires a flexible door 80 to be used and may be considered somewhat more secure than the previous embodiments in maintaining the door in place. It is, however, more difficult to lift the free end 80*a* of the door to begin sliding the door 80 toward the left in the retaining slots 86 to remove it.

Many modifications can be made; for example, the entire article can be formed in a single operation using moe complex molds. The elastic mold cavities can be formed from a variety of materials such as an elastic polyurethane resin.

Many other variations of the invention within the scope of the appended claims will be apparent to those skilled in the art once the principles of the invention are understood.

What is claimed is:

1. An article hiding container for keys and similar items comprising a unitary and integral solid body formed from a single piece of plastic resin having a contoured upper surface and a lower support surface, said upper surface having an irregular shape composed of portions having different contours and surface irregularities therein to resemble a stone, said upper surface defining continuous and uninterrupted top and side walls and said walls being free from openings which, if present, could expose the interior of the article to view or otherwise indicate that the article was not a real stone, said container body having an article holding pocket therein communicating only with the lower support surface, said container body including side wall portions surrounding the pocket on all sides thereof to space the pocket away from the side wall of the stone whereby an open end of the pocket is located in the lower support surface with portions of the support surface wall surrounding the open end on all sides and spacing the open end of the pocket inwardly from the peripheral edge of the lower support surface on all sides, the pocket being of a larger size than keys that are to be held therein such that one or more keys will fit loosely within the pocket and being thereby enclosed but otherwise unconnected to the container body for quick removal from the container body by being free to fall out through said open end whereby any one of several of said keys can be removed without being disconnected mechanically from the container body and the others allowed to remain in place, said open end having a pair of horizontally disposed retaining slots adjacent the open end of the pocket in parallel relationship and facing one another, said slots running along opposite sides of the open end and being spaced inwardly from the support surface, a door having a pair of parallel side edges adapted to fit in the slot and to slide in and out to either cover or expose articles held in the pocket, the lower support surface being formed as an extended support means of substantial width and breadth and being sufficiently flat to allow the container to be stable when resting on the ground and the slots being spaced inwardly from the support surface to hold the cover in place over the pocket while the portions of the support surface surrounding the pocket on all sides hide the edges of the cover from view when the container rests on the ground in an upright position.

2. The container of claim 1 wherein the container body is composed of a single piece of homogeneous thermosetting rigid plastic resin and said upper surface is imperforate.

3. The article of claim 2 wherein the resin comprises a polyester resin.

4. The article of claim 1 wherein at least the upper surface of the container body is stained to resemble a rock.

5. The article of claim 1 wherein the lower support surface is rendered smooth by grinding or planing away surface material to define a flat supporting surface that projects laterally in all directions and on all sides of the open end of the pocket.

6. The article of claim 1 wherein the container body is composed of a water-extended polyester resin intimately mixed with water and a polyester resin catalyst in sufficient quantity to rigidify the mixture of resin and water and the lower support surface serves as a reference plane for forming the door-receiving slots and said slots are routed in the article through the operation of a router positioned to cut the slots a predetermined distance inwardly from the reference plane defined by the lower surface of the container body thereby spacing the door in its closed position inwardly from the lower support surface and centrally from the peripheral edge of the side wall to thereby hide the door when the container is in an upright position.

* * * * *